United States Patent [19]

Leinfelt

[11] 4,277,265

[45] Jul. 7, 1981

[54] COMPRESSING ARRANGEMENT FOR A DUST CONTAINER

[75] Inventor: Karl E. Leinfelt, Stockholm, Sweden

[73] Assignee: Aktiebolaget Electrolux, Stockholm, Sweden

[21] Appl. No.: 86,353

[22] Filed: Oct. 19, 1979

[30] Foreign Application Priority Data

Oct. 19, 1978 [SE] Sweden ..... 7810881

[51] Int. Cl.[3] ..... B01D 46/04

[52] U.S. Cl. ..... 55/302; 55/380; 55/418; 55/428; 55/467

[58] Field of Search ..... 55/96, 274, 291, 299, 55/302, 304, 380, 305, 428, 467, 418, 471–473; 15/327 E, 352, 353, 339

[56] References Cited

U.S. PATENT DOCUMENTS

| | | | |
|---|---|---|---|
| 842,661 | 1/1907 | Hein | 55/372 |
| 1,069,754 | 8/1913 | Baillie | 55/310 |
| 1,153,751 | 9/1915 | Beth | 55/302 |
| 1,504,136 | 8/1924 | Patterson | 55/364 |
| 2,543,556 | 2/1951 | Senne | 55/376 |
| 2,916,104 | 12/1959 | Hultberg et al. | 55/298 |
| 3,364,663 | 1/1968 | Lagerstrom | 55/380 |
| 4,145,196 | 3/1979 | Alskog | 55/380 |

FOREIGN PATENT DOCUMENTS

| | | | |
|---|---|---|---|
| 1052086 | 9/1953 | France | 55/380 |
| 324045 | 2/1972 | U.S.S.R. | 55/302 |

OTHER PUBLICATIONS

RA Packaged Dust Collector Dustex Bulletin 311 pp. 1–8 dtd 5/11/72.

*Primary Examiner*—Bernard Nozick
*Attorney, Agent, or Firm*—Alfred E. Miller

[57] ABSTRACT

A compressible dust container for a vacuum cleaner, which is compressed by means of a device that causes a change in pressure between the outside and inside of the dust container, as well as agitating the container. The dust container is then able to be filled to substantial capacity without a false reading on the dust indicator of the vacuum cleaner.

9 Claims, 2 Drawing Figures

COMPRESSING ARRANGEMENT FOR A DUST CONTAINER

BACKGROUND OF THE INVENTION

The pores in the filtering surface of dust containers used in vacuum cleaners become clogged after a certain period of operation, so that even if the dust container is only partially filled the pressure drop over the container wall has increased so much that an indicating device, which usually senses this pressure drop, gives a false indication that the container is filled, and should be exchanged. Of course, this situation is undesirable and, moreover, it is not economical.

Different types of filter shaking devices are known, which in most cases are mechanical and have a principal purpose of loosening the dust from the filter surface of the dust container, and in this way, results in the continued use of the dust container and the increase of filling capacity thereof. Often the contents of the dust container have a fluffy structure, which results in that the desired effect cannot be obtained by means of filter shaking only.

The present invention relates to a compressing device for a dust container, i.e. intended for vacuum cleaners, comprising a chamber with an inlet for dust laden air, an outlet for cleaned air and a motor fan unit for transporting air from the working implement through a suction hose and the dust container disposed in the chamber.

An object of the present invention is to eliminate the above-mentioned drawback and to construct a simple device for increasing the filling degree of the dust container. For this purpose the invention is mainly characterized in that the dust container, by changing the pressure conditions between the inside and outside, respectively, of the dust container, the latter is compressible so that its inner volume during a certain time interval becomes smaller than the original volume thereof.

In order that the invention will be more clearly understood, it will now be disclosed in greater detail with reference to the accompanying drawings, in which:

FIG. 1 is a sectional view through a chamber enclosing the dust container during normal operation thereof, and FIG. 2 is a sectional view through the same chamber, with the dust container in a compressed condition.

DESCRIPTION OF PREFERRED EMBODIMENT

Figure 1:
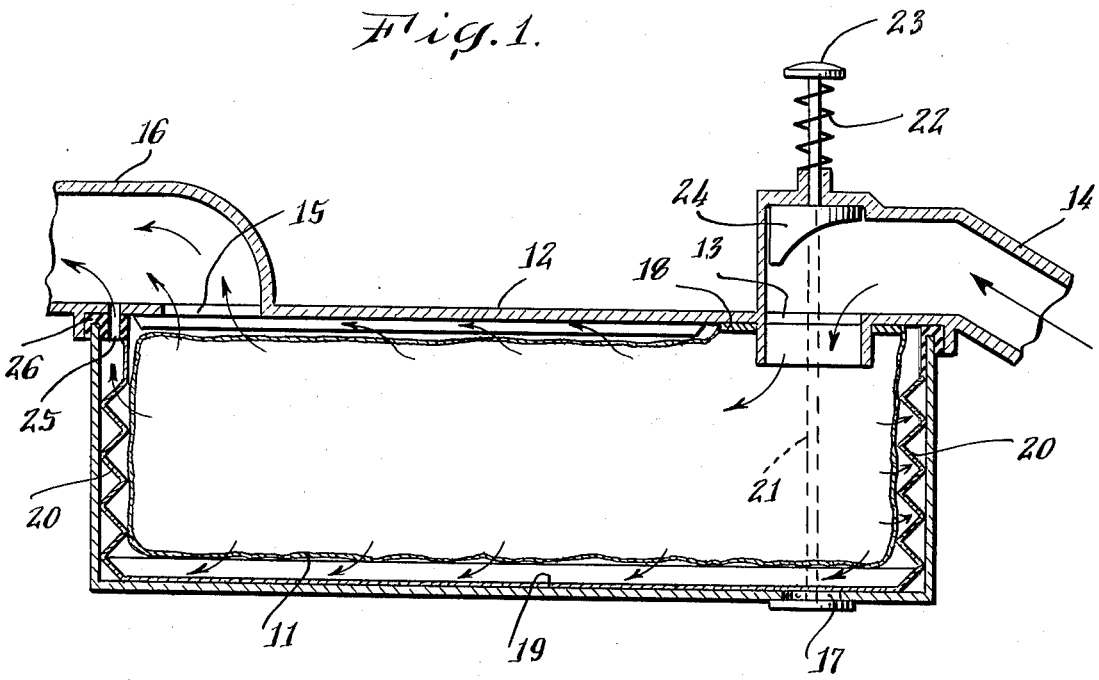

A chamber 10 is shown enclosing a dust container 11. The chamber is closable by a cover 12, and has an inlet opening 13 for entry of dust laden air through an inlet conduit and a suction hose (not shown) from the working implement, such as a nozzle. An outlet opening 15 communicates through an outlet conduit 16 with a motor fan unit (not shown). A third opening 17 connects the inside of the chamber 10 with atmospheric air. The dust container is connected to the inlet conduit 14 by means of an attachment plate 18 with an opening.

Between the dust container 11 and the chamber 10 a shroud 19 of flexible material is arranged. The shroud is mainly U-shaped and has its open end attached to the chamber wall provided with the inlet opening 13, and the outlet opening 15. The side portions 20 of the shroud have the form of a compressible bellows.

The opening 17 is closed during normal operation, but can be opened by means of a valve 21 so that connection between the inside of the chamber 10 and atmospheric air can be obtained. A spring 22 holds the valve in the opening 17 in a closed position. A manually actuatable push button 23 is accessible from the outside of the chamber 10 for actuating the valve 21. In its upper portion, the valve 21 has another blocking device 24 arranged so that when the valve is pressed down by the push button 23, the inlet opening 13 is closed. A leak opening 25 is provided in the chamber 10, and connects the space between the shroud 19 and the chamber 10 with the outlet conduit 16. A seal 26, for example, made of rubber, is arranged between the chamber 10 and its cover 12.

The present arrangement functions in the following way:

During normal operation, as shown in FIG. 1, dust laden air flows through the inlet conduit 14, and passes through the filtering surface of the dust container 11, where it is freed from dust particles and through the space between the dust container 11 and the shroud 19 the cleaned air leaves the chamber 10 through the outlet conduit 16.

Figure 2:
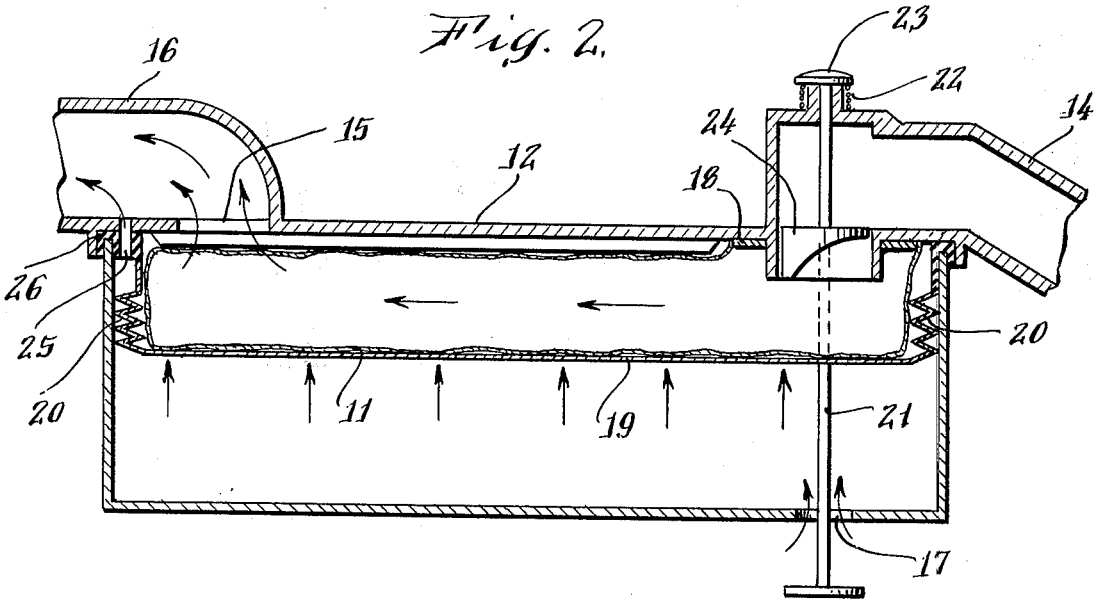

After having been used for certain periods of time, the dust container 11 becomes filled with dust and dirt and the air resistance over the dust container wall increases. This situation can result in the signalling device of the dust container indicating a full dust container without the bag being completely filled. In order to increase the filling degree of the dust container, a valve is actuated by means of the push button 23 so that the opening 17 is temporarily uncovered. At the same time the inlet opening 13 is closed by means of a blocking device 24, atmospheric air propels through the opening 17 into the space between the shroud 19 and the chamber 10, where a negative pressure has prevailed before. Thus, the dust container due to this change in pressure between the inside and outside of the dust container is compressed, as shown in FIG. 2. The dust inside of the dust container is compressed by the inner volume of the dust container becoming smaller than its original volume. In addition to this compression, a certain shaking of the filtering surface of the dust container is effected so that when the push button 23 is released and the valve 21 returns to its position shown in FIG. 1, it is possible to supply more dust to the dust container. This procedure can be repeated several times to increase the filling of the dust container. Tests have shown that due to the present compressing device the filling degree of the dust container can be increased by about 30% compared with a dust container that is devoid of the device. The leak opening 25 is always open and due to the fact that it is in connection with the outlet conduit 16 the space between the casing 19 and the chamber 10 is evacuated. After the valve 21 has been closed, the shroud 19 and the dust container 11 resume the position shown in FIG. 1.

The embodiment shown is not intended to limit the extent of the invention and several modifications are conceivable within the spirit and scope of the invention. In this regard part of the filtering surface of the dust container can be made of resilient, air nonpervious material and replace the shroud 19.

What is claimed is:

1. A compressing arrangement for a flexible filter-type dust container of the type used with a vacuum cleaner, a motor-fan assembly, a hand-held working implement and suction hose comprising: a chamber having an inlet for dust and dirt laden air, said filter dust container positioned in said chamber and connected to said inlet, an outlet for air substantially devoid of dirt and dust, said motor-fan assembly transporting said air from said work implement through said suction hose inlet, and said dust container whereby said dust and dirt are separated in said container and cleaned air leaves said chamber through said outlet, a substantially flexible body at least partially surrounding said container, and means selectively and operatively connected to said chamber for permitting the introduction of atmospheric pressure conditions between the interior of said chamber and the outside of said dust container to thereby compress said container with the aid of said air-impermeable body whereby the inner volume of the dust container during a certain period of time becomes smaller than the original volume of said container and alternately to maintain suction conditions within said container.

2. A compressing arrangement for a dust container as claimed in claim 1 wherein said means selectively and operatively connected to said chamber for changing the pressure conditions between the inside and outside of said dust container is a valve arranged through one of the walls of said chamber whereby when actuated uncovers an opening in said chamber which connects the outside of said dust container in said chamber with atmospheric air.

3. A compressing arrangement for a dust container as claimed in claim 2 wherein said valve is further provided with a blocking member which during the actuation of said valve is arranged to close said inlet opening.

4. A compressing arrangement for a dust container as claimed in claim 2 further comprising a spring which during normal operation holds said valve in a closed condition against said valve opening.

5. A compressing arrangement for a dust container as claimed in claim 1 further comprising a leak opening in one of the chamber walls, said leak opening connecting the area outside of said dust container, but within said chamber, with said outlet conduit.

6. A compressing arrangement for a dust container as claimed in claim 5 wherein the cross sectional area of said leak opening is considerably smaller than the cross section area of said outlet opening.

7. A compressing arrangement for a flexible filtering dust container of the type used with a vacuum cleaner, a motor-fan assembly, and a hand-held working implement and suction hose comprising: a chamber having an inlet for dust and dirt laden air, an outlet for air substantially devoid of dirt and dust, said motor-fan assembly transporting said air from said work implement through said suction hose inlet which is operatively connected to said dust container, the latter being arranged in said chamber for separating dust and dirt while cleaned air leaves said chamber through said outlet, a shroud of resilient filter material located in said chamber and at least partially enclosing said dust container, and means selectively and operatively connected to said chamber for permitting the introduction of atmospheric pressure conditions between the interior of said chamber and the outside of said dust container to thereby compress said container with the aid of said shroud whereby the inner volume thereof during a certain period of time becomes smaller than the original volume of said container and alternately to maintain suction conditions within said container.

8. A compressing arrangement for a dust container as claimed in claim 7 wherein said shroud is substantially U-shaped with its open end attached to a chamber wall adjacent to said inlet opening and said outlet opening.

9. A compressing arrangement for a dust container as claimed in claim 5 wherein the side portions of said shroud are in the form of a compressible bellows.

* * * * *